United States Patent [19]

Nelson et al.

[11] 4,006,323

[45] Feb. 1, 1977

[54] ELECTRICAL TERMINAL STRUCTURE

[75] Inventors: Terrance D. Nelson, Milwaukee; Donald W. Kuntzsch, West Allis, both of Wis.

[73] Assignee: Allen-Bradley Company, Milwaukee, Wis.

[22] Filed: May 21, 1975

[21] Appl. No.: 579,517

[52] U.S. Cl. ..... 200/284; 339/272 A

[51] Int. Cl.[2] ..... H01R 7/12

[58] Field of Search ..... 200/284; 339/272 R, 339/272 A, 272 UC

[56] References Cited

UNITED STATES PATENTS 3,434,103 3/1969 Hancock et al. ..... 339/272

*Primary Examiner*—Herman T. Hohauser
*Attorney, Agent, or Firm*—Quarles & Brady

[57] ABSTRACT

A switch cartridge wedgingly retains an electrical terminal structure having a terminal housing with a hollow interior which receives a threaded fastener and a terminal. The threaded fastener carries a pressure plate which is restrained against rotation and translated toward the terminal upon tightening of the fastener within the terminal housing. A wire is inserted into the terminal housing and firmly held between the pressure plate and the terminal by tightening the fastener thereby making a direct wire to terminal contact.

7 Claims, 5 Drawing Figures

Fig. 3
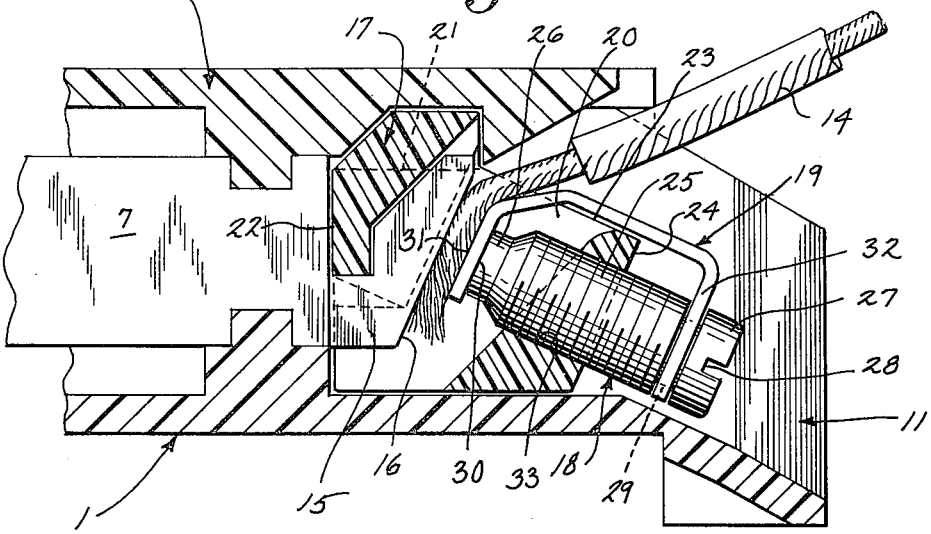
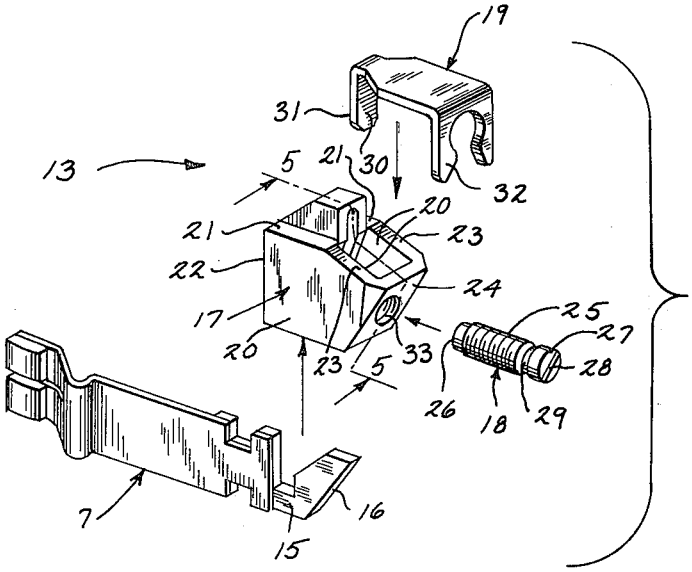
Fig. 4
Fig. 5
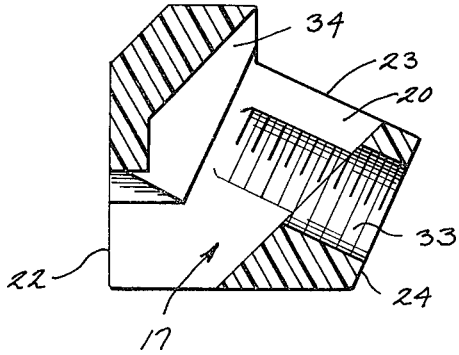

ELECTRICAL TERMINAL STRUCTURE

BACKGROUND OF THE INVENTION

This invention relates to terminal structures, and more particularly, to a fastener for connecting a wire to a terminal in a switch cartridge of the type shown in the patents issued to Nelson et al., U.S. Pat. No. 3,770,925 on Nov. 6, 1973, for "Switch Mounting Structure" and Funke, U.S. Pat. no. 3,745,493, on July 10, 1973, for "Reed Switch Cartridge."

Oil-tight switches are commonly provided with one or more switch cartridges. These cartridges contain a plunger extending into the switch actuator section which operably moves the plunger thereby selectively opening or closing one or more switch contacts within the cartridge. Each contact includes a contact end which removably receives a connector having an insulating sleeve that is typically soldered on, and encloses, a wire. This connecting arrangement is highly satisfactory, but it does present a problem in that each time it is desired to connect a wire to a contact it is necessary to expend time in attaching a sleeve to the wire. It would be desirable to avoid this preliminary step which must be performed before a wire can be connected to a contact. Also, this connecting arrangement does not provide a direct wire to terminal contact.

SUMMARY OF THE INVENTION

The present invention contemplates an improved fastener for connecting a wire to a terminal in a switch cartridge. More specifically, the invention includes a switch cartridge having a plunger retained within the cartridge framework for movement between actuated and unactuated positions and having a switch which is mounted to one side of the plunger and which has a pair of contacts each having a contact end; a terminal housing retained within a receptacle which is formed in the cartridge framework; a terminal support member partially disposed within the interior of the terminal housing and extending outwardly of the terminal housing to form an enlargement of the periphery of one of its sides; a terminal member which is attached to the contact end and which clasps the terminal support member, the terminal member having a terminal surface; an elongated threaded fastener within the terminal housing defining a longitudinal fastening axis; and a pressure plate carried by the elongated threaded fastener and restrained against rotation during turning movement of the elongated threaded fastener, the pressure plate having a wire contact surface opposing the terminal surface of the terminal member to form a wire receiving mouth therebetween and to define a wire axis passing therethrough, the wire axis intersecting the longitudinal fastening axis.

It is a particular object of the invention to facilitate connecting wires to the contact ends of the contacts in a switch cartridge. Each contact end has a terminal member which is secured to a terminal housing. A wire may be inserted into the housing for clamping against the terminal member within the housing by tightening a set screw. This structure avoids the necessity of performing any perparatory operation on the wire such as attaching an insulating sleeve, and prevents any extraneous electrical contact with the wire.

It is another particular object of the invention to provide a direct electrical connection between a wire and the contact end of each contact in a switch cartridge. When the terminal member of a contact end is inserted into a terminal housing, a terminal surface on the terminal member faces a pressure plate attached to a set screw. Upon tightening of the screw, the pressure plate is translated toward the terminal member until it firmly secures the wire against the terminal surface. A direct wire-terminal electrical contact is maintained, yet the wire can be readily removed from the terminal housing by untightening the set screw.

Another object of the invention is to provide a screw-type terminal structure for the contact ends in a switch cartridge in which a wire is not subjected to turning forces during fastening. A pressure plate which is restrained against rotation during turning of the set screw is interposed between the end of the screw and the wire. This feature minimizes the amount of turning motion applied to the wire reducing the possibility that the threads of the wire will become spread or that the wire will become misaligned with respect to the contact end resulting in poor electrical connection.

The foregoing and other objects and advantages of the invention will appear from the following description. In the description reference is made to the accompanying drawings which form a part hereof, and in which there is shown by way of illustration and not of limitation a preferred embodiment of the invention. Such embodiment does not represent the full scope of the invention, but rather the invention may be employed in many different embodiments, and reference is made to the claims herein for interpreting the breadth of the invention.

BRIEF DESCRIPTION OF THE DRAWINGS

FIG. 3 is a view in cross-section taken along the plane of the line 3—3 shown in FIG. 1;

FIG. 4 is an exploded perspective view of the electrical terminal structure of FIG. 1; and FIG. 5 is a view in cross-section taken along the plane of the line 5—5 shown in FIG. 4.

DESCRIPTION OF THE PREFERRED EMBODIMENT

Figure 1:
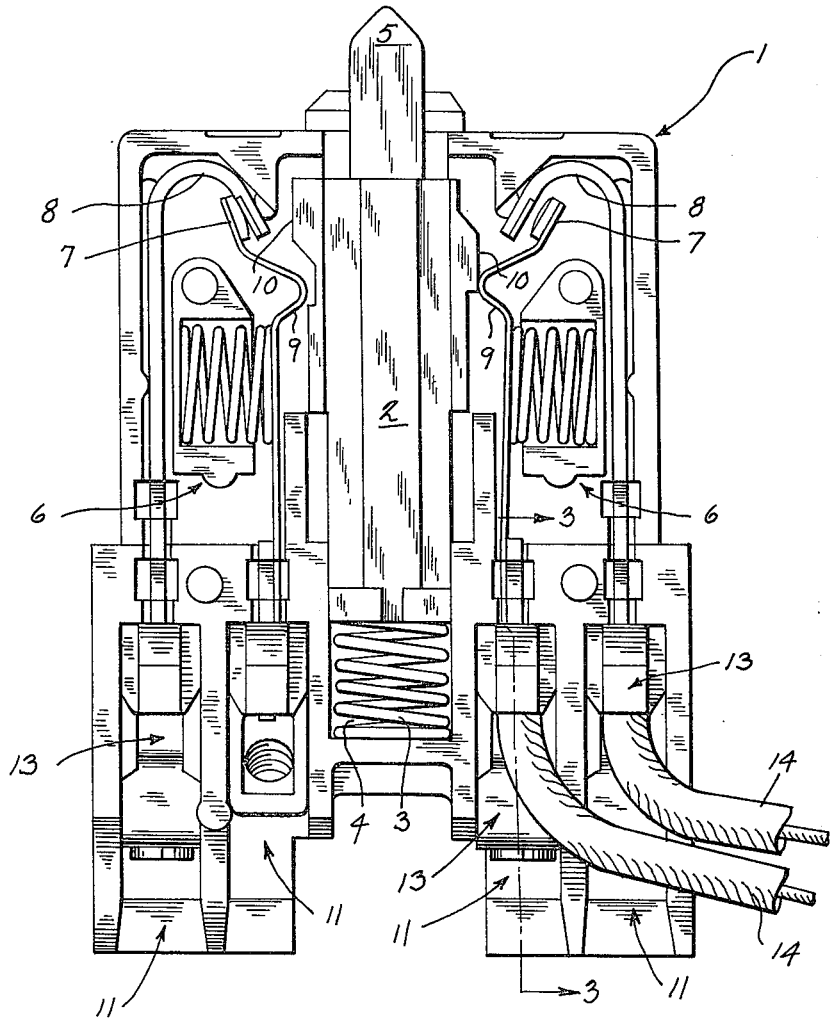
FIG. 1 is a view in cross-section of a switch cartridge containing an electrical terminal structure which incorporates the present invention.

Referring to FIG. 1, a switch cartridge 1 is shown which includes a plunger 2 that is slidably retained therein for limited movement between unactuated and actuated positions. The plunger 2 is biased in its unactuated or forward position by a spring 3 within a compartment 4 integrally formed in the cartridge framework. The plunger 2 includes an operator 5 which extends into the actuator section of an electric switch adapted for attachment to a control panel. A single pole, single throw switch 6 which includes a movable contact 7 is mounted on each side of the plunger 2 and operated by the axial translation thereof. Each movable contact 7 has a forward end which bears against a stationary contact 8 when the movable contact 7 is moved to its closed position. Each movable contact 7 also includes a cam follower portion 9, while the plunger 2 has a cam 10 formed on each side. The switches 6 are operated by the action of the cams 10 on the cam follower portions 9 of the movable contacts 7--when the plunger 2 is in its unactuated position, one of the switches is open and the other closed; and, when the plunger is in its actuated position, the previously closed switch is open and the previously open switch is closed. Further disclosure of the switch cartridge 1 can be had by reference to the aforementioned U.S. patent issued to Nelson et al., No. 3,745,493, on Nov. 6, 1973.

Figure 2:
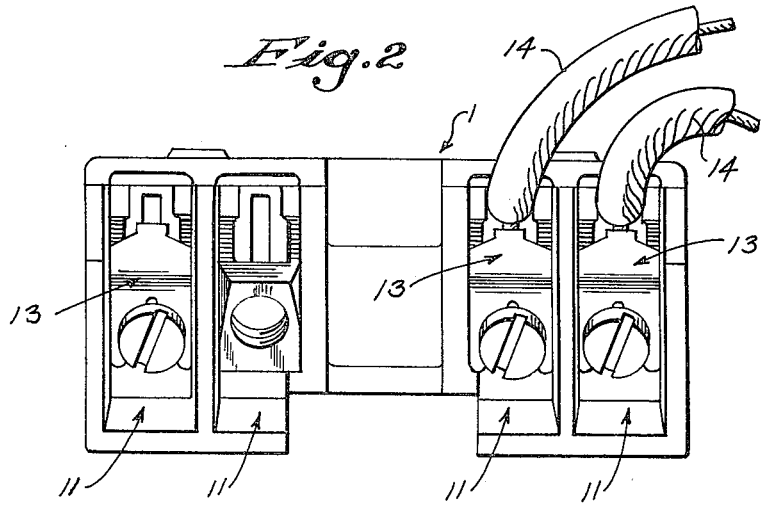
FIG. 2 is an end view of the switch cartridge of FIG. 1.

Referring now to FIGS. 1, 2 and 3, the switch cartridge 1 also includes four receptacles 11 which are integrally formed in, and near the bottom of, the cartridge framework. In combination with a cover 12 for the switch cartridge 1, each receptacle 11 provides an enclosure for a terminal structure, generally indicated by the reference numeral 13, which is wedgingly retained therein. Each terminal structure 13 furnishes a shelter for the connection between a wire 14 and one of the contacts 7 and 8 within the interior thereof. Each of the contacts 7 and 8 has a contact end which includes a terminal member or lug 15, which has a terminal surface 16, welded thereto that is received within the terminal structure 13.

With particular reference to FIG. 4, each terminal structure 13 is composed of a terminal housing 17, a threaded fastener 18 and a pressure plate 19. The terminal housing 17 is a multifacetted member which is essentially a heptahedron having a pair of spaced, parallel side walls 20, a pair of spaced, parallel end walls 21, a forward housing wall 22, and a rearward housing wall consisting of a pair of inclined portions 23 and 24. The forward housing wall 22 is substantially perpendicular to the side and end walls 20 and 21; the inclined portions 23 and 24 are angled with respect to the forward housing wall 22 and intersect to form an apex in the rearward housing wall.

The threaded fastener 18 has a longitudinally elongated span 25 extending between longitudinally opposed forward and rearward ends 26 and 27, respectively. The elongated span 25 is threaded for facilitating twisting movement within a threaded aperture, and the rearward end 27 has a transverse groove 28 capable of receiving a tightening implement. An annular neck 29 is formed in the span 25 near the rearward end 27 of the fastener 18 and provides a connection point between the threaded fastener 18 and the pressure plate 19. The pressure plate 19 is generally U-shaped and includes a forward leg 30 having a flat wire contact surface 31 and a bifurcated rearward leg having a pair of prongs 32. The prongs 32 removably grip the annular neck 29 on the fastener 18, and, when so connected, the bight of the pressure plate 19 extends parallel to the span 25 and the forward leg 30 is slightly spaced forwardly of the forward end 26 of the fastener 18.

Referring now to FIGS. 3 and 5, each terminal housing 17 has a hollow interior in which the connection between a wire 14 and one of the contacts 7 or 8 is made. The inclined portion 23 has an opening through which the wire 14 is inserted into the hollow interior of the terminal housing 17. The inclined portion 24 has an internally threaded aperture 33 and the side walls 20 have opposed interior threaded surfaces—the threaded fastener 18 being received by, and capable of turning motion within, the threaded aperture 33 and threaded side walls 20. The forward housing wall 22 has a opening which receives the terminal member 15. The interior surfaces of the side walls 20 also have a terminal support member 34 integrally extending therebetween which clasps the terminal member 15 in the terminal housing interior. The terminal support member 34 is partially disposed within the terminal housing interior and extends outwardly therefrom to form an enlargement on the periphery of end wall 21. The configurtion of the terminal support member 34 conforms to that of the terminal member 15. This configuration is generally hook-like and in mating the terminal member 15 with the terminal support member 34 a firm union between contacts 7 or 8 and the terminal housing 17 is insured.

To assemble a terminal structure 13, the terminal member 15 of one of the contacts 7 or 8 is inserted into the terminal housing 17 so that it clasps the terminal support member 34. This places the terminal surface 16 of the terminal member 15 in substantially parallel alignment with the inclined portion 24 of the terminal housing 17. The threaded fastener 18 is then turned within the threaded aperture 33 and between the threaded side walls 20 until it protrudes into the interior of the terminal housing 17. The prongs 32 of the pressure plate 19 are attached to the neck 29 on the fastener 18 and its forward leg 30 placed in the interior of the terminal housing 17 disposed between the forward end 26 of the threaded fastener 18 and the terminal member 15. At this point, the terminal surface 16 of the terminal member 15 is parallel to the contact surface 31 on the forward leg 30 of the pressure plate 19 and opposed thereto and in combination therewith forms a wire-receiving mouth therebetween. The wire 14 is inserted through the opening in inclined portion 23 into the interior of the terminal housing 17 until its exposed end is situated within the wire-receiving mouth. The threaded fastener 18 is further tightened within aperture 33 until pressure is transmitted from forward end 26 to forward leg 30 firmly connecting the wire 14 to the terminal surface 16 on terminal member 15. This type of connection insures a tight contact between the wire 14 and the terminal member 15 through direct force exerted by a tightening of threaded fastener 18, yet does not directly expose the wire 14 to the fastener 18 or its threaded span 25.

When the terminal structure 13 is assembled and a wire 14 connected to the terminal member 15 therewithin, the central axis of the connected wire portion is substantially perpendicular to the threaded fastener 18. The connected wire portion mechanically contacts the terminal member 15 forward leg 30 of the pressure plate 19, and thus makes electrical contact with a contact 7 or 8. During turning motion of the fastener 18, the pressure plate 19 is translated toward the inserted wire portion and the terminal member 15, and restrained by the housing side walls 20 from rotation. Further fastener tightening eventually brings the fastener into abutment with forward leg 30 firmly pressing it against the exposed wire portion. The forward leg 30 provides a flat wire contact surface that does not impart substantial twisting forces to the wire during tightening of the fastener 18. The wire 14 is easily removed from the assembled terminal structure 13 by untightening the fastener 18 releasing the pressure holding the wire 14 against the terminal member 15, and pulling the wire through the opening in inclined portion 23.

We claim:

1. A switch cartridge, the combination comprising:

a plunger within the cartridge framework;

a switch mounted within the cartridge framework to one side of the plunger and which is actuated by the axial movement thereof;

said switch including a pair of contacts, one of which has a contact end, the contact end extending into a receptacle in the cartridge framework;

a terminal member attached to the contact end and having a terminal surface within the receptacle;

a terminal housing wedgingly retained within the receptacle and having an interior terminal support member which is configured to receive and retain said terminal member;

said terminal member having a portion conforming to the terminal support and mating with the terminal support member to provide a firm union between the contact end and the terminal housing;

an elongated threaded fastener within said terminal housing;

a pressure plate carried by said elongated threaded fastener and restrained against rotation during turning movement of said elongated threaded fastener;

said pressure plate having a wire contact surface opposing the terminal surface of said terminal member and being substantially parallel thereto to form a wire receiving mouth between the wire contact surface and the terminal surface;

the wire contact surface being brought into contact with a wire when inserted between the wire contact surface and the terminal surface by rotation of said elongated threaded fastener to provide a direct contact between the wire and said terminal member in said switch cartridge.

2. The combination as recited in claim 1, wherein said terminal housing includes:

forward and rearward housing walls spaced from one another and a pair of spaced housing side walls which extend between said forward and rearward housing walls, said rearward housing wall having a threaded aperture which receives said elongated threaded fastener and said forward housing wall having an opening which receives said terminal member.

3. The combination as recited in claim 2, wherein said rearward housing wall includes a pair of integrally connected inclined portions, one of said inclined portions having said threaded aperture therein, so that when said elongated threaded fastener is disposed within said threaded aperture said longitudinal fastening axis is inclined at an angle with respect to the plane of said forward housing wall.

4. The combination as recited in claim 2, wherein said housing side walls each have an interior threaded surface, the interior threaded surfaces being opposed to one another and receiving therebetween said elongated threaded fastener.

5. The combination as recited in claim 1, wherein said terminal member has a configuration which conforms to the configuration of said terminal support member, said terminal member mating with said terminal support member to maintain said terminal housing within said switch cartridge framework and align said terminal surface in generally parallel relationship with said wire contact surface.

6. A switch cartridge, the combination comprising:

a plunger within the cartridge framework;

a switch mounted within the cartridge framework to one side of the plunger and which is actuated by the axial movement thereof;

said switch including a pair of contacts, one of which has a contact end, the contact end extending into a receptacle in the cartridge framework;

a polyhedral terminal housing wedgingly retained within a receptacle which is formed in the cartridge framework, said terminal housing having a hollow interior, a first housing wall which has a threaded aperture, a second housing wall which has a terminal-receiving opening and a third housing wall which has a wire-receiving entrance, the hollow interior of said terminal housing being adapted to receive a wire;

an elongated threaded fastener having one end disposed within the hollow interior of said terminal housing and which is rotatably removable therefrom through the threaded aperture in the first housing wall;

a pressure plate having a first end disposed within the hollow interior of said terminal housing and a second end carried by said elongated threaded fastener, said pressure plate being restrained against rotation during rotational movement of said elongated threaded fastener within the threaded aperture; and a terminal member attached to the contact end and having a terminal surface at one of its ends, said terminal member being connected to said terminal housing in the interior thereof with a firm mechanical fit and being removable from the terminal-receiving opening in the second housing wall;

said elongated threaded fastener being rotatable within the threaded aperture towards said terminal member to bring the first end of said pressure plate against a wire inserted through the wire-receiving entrance in the third housing wall to provide a direct contact between the wire and said terminal member in said switch cartridge.

7. The combination as recited in claim 6 wherein:

a terminal support member is mounted to, and disposed in, said terminal housing; and said terminal member is generally hook-like and mates with said terminal support member to align said terminal surface in generally parallel relatiohship with said wire contact surface.

* * * * *